United States Patent [19]

Choinski

[11] Patent Number: 4,489,671

[45] Date of Patent: Dec. 25, 1984

[54] COATING APPARATUS

[75] Inventor: Edward J. Choinski, Wayland, Mass.

[73] Assignee: Polaroid Corporation, Cambridge, Mass.

[21] Appl. No.: 498,079

[22] Filed: May 25, 1983

Related U.S. Application Data

[63] Continuation of Ser. No. 921,445, Jul. 3, 1978, abandoned.

[51] Int. Cl.[3] ..... B05C 5/02

[52] U.S. Cl. ..... 118/412; 118/266; 118/401

[58] Field of Search ..... 118/410, 411, 412, 401, 118/266, 267, 325, DIG. 4, 324

[56] References Cited

U.S. PATENT DOCUMENTS

| | | | |
|---|---|---|---|
| 402,188 | 4/1889 | Peregrine | 118/267 X |
| 3,289,632 | 12/1966 | Barstow | 118/412 |
| 3,365,325 | 1/1968 | Fraenkel et al. | 118/DIG. 4 |
| 3,711,312 | 1/1973 | Yoshida et al. | 118/411 X |
| 3,828,725 | 8/1974 | Lewicki, Jr. | 118/DIG. 4 |
| 3,893,410 | 7/1975 | Herzhoff et al. | 118/412 |
| 4,033,290 | 7/1977 | Dude | 118/266 |

*Primary Examiner*—John P. McIntosh
*Attorney, Agent, or Firm*—John J. Kelleher

[57] ABSTRACT

Coating apparatus for slide, extrusion or curtain coating of one or more liquids on a moving web in which the metering orifice for each fluid to be coated is filled with a porous plug.

4 Claims, 6 Drawing Figures

COATING APPARATUS

This is a continuation of application Ser. No. 921,445, filed July 3, 1978, now abandoned.

This invention relates to the art of coating webs, and particularly to a novel applicator construction for bead, extrusion and curtain coating.

For applications such as the manufacture of photographic products by coating liquid compositions on a moving web, it is conventional to supply the compositions to the web through narrow coating slots. Apparatus for this purpose is shown, for example, in U.S. Pat. No. 3,289,632, issued on Dec. 6, 1966 to F. C. Barstow for Cascade Coating Apparatus For Applying Plural Layers of Coating Material To A Moving Web, and assigned to the assignee of this application. Since such coating slots may be several feet wide in commerical practice, it is conventional to make the coating apparatus of massive construction so that the heights of the slots can be kept as uniform as possible across the width of the slots. A factor that exacerbates the problem is that the height of a coating slot must be small enough to present a substantial impedance to fluid flow in order to keep any cross-stream pressure drop upstream of the slot as small as possible relative to the downstream pressure drop through the slot.

One object of the invention is to improve the uniformity and accuracy with which coating compositions can be metered onto a web through coating slots with given tolerances on the slots. Another object is to alleviate the problems caused by particulate buildup in coating apparatus.

The above, and other objects and advantages of the invention that will be apparent from the following description, are attained by a coating applicator in which a liquid composition to be coated on a web is metered onto the web through a porous body of material forming a flow channel, such as a coating slot, of high fluid friction relative to its cross-sectional area. The porous material may be of light polymeric open cell material. Because of the high fluid friction relative to the area of the flow channel, the controlling dimension, such as coating slot height, can be much larger than in a conventional open channel coater. Thus, accurate and uniform coating weights can be attained with dimensional tolerances that would be completely unacceptable in an open channel coater.

Since it is not necessary to maintain such close tolerances, extreme structural rigidity of the apparatus is not necessary, and a much lighter construction can be employed. In one embodiment of the invention to be described, maximum advantage of this fact is taken by making substantially the entire applicator of porous plastic material.

An important consequence of the larger metering channels that can be employed in accordance with the invention is that small particulate matter that comes in with the coating composition, or more usually, gradually builds up in the applicator, is much smaller relative to the controlling metering dimension that in open slot coaters. In some embodiments of the invention to be described, further advantage of this property of apparatus in accordance with the invention is taken by making the porous body larger at the upstream end.

The apparatus of the invention, and its mode of operation, will best be understood in the light of the following detailed description, together with the accompanying drawings, of various illustrative embodiments.

Figure 1:
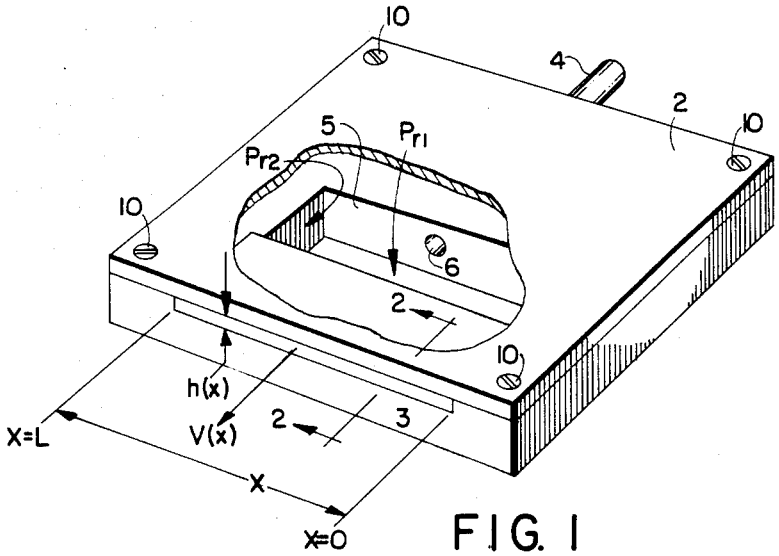
FIG. 1 is a schematic perspective three-quarter sketch, with parts broken away, of a cascade slide applicator in accordance with one embodiment of the invention.
Figure 3:
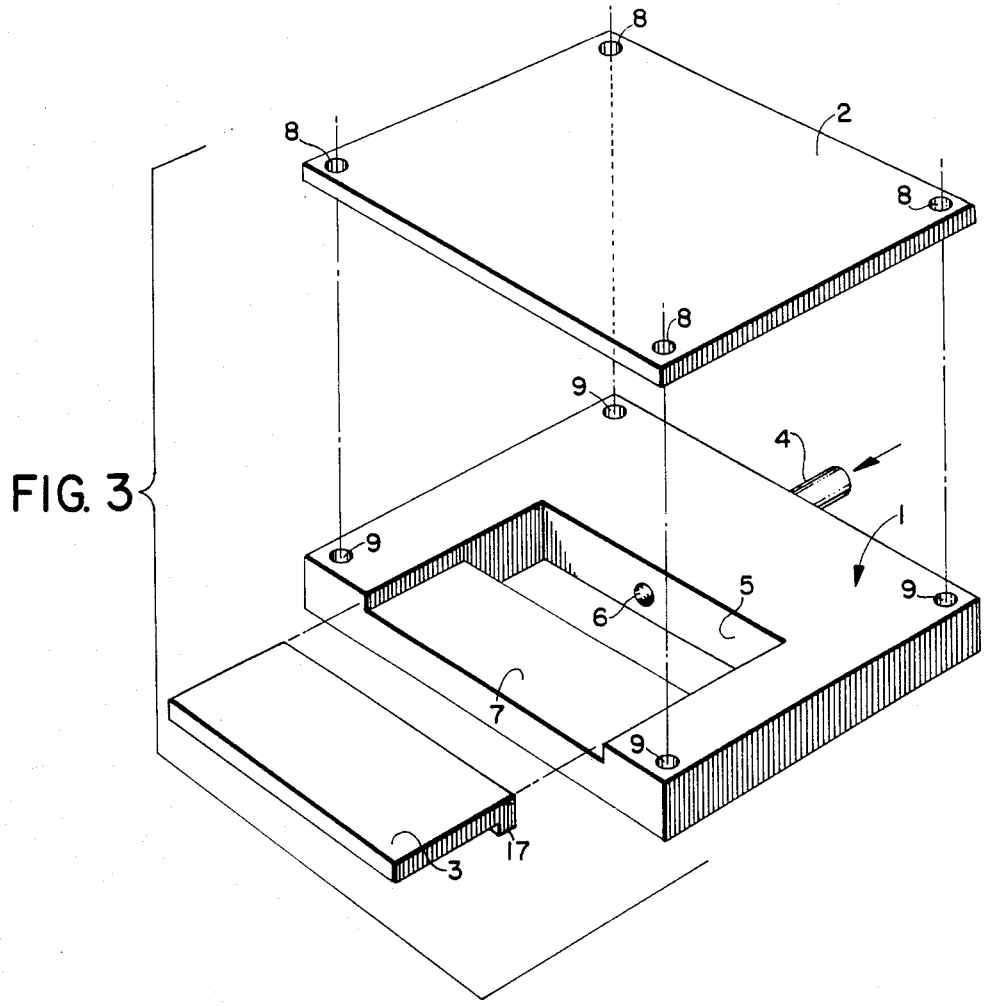
FIG. 3 is an exploded schematic perspective sketch of the apparatus of FIG. 1.

Referring to FIGS. 1 and 3, an applicator in accordance with one embodiment of the invention comprises a body portion 1, a cover panel 2 and a porous plug 3. The body 1 and cover panel 2 may be formed of stainless steel, for example. The plug 3 may be of any porous material that is chemically inert and insoluble in the liquid composition to be coated, such as porous polyethylene, polypropylene, a fluorocarbon polymer or the like. Porex porous plastics as made and sold by Porex Division of Fairburn, Ga. are suitable materials. Such materials are available in pore sizes from 10 microns to 500 microns.

The body 1 is provided with an inlet pipe 4 through which a fluid composition to be coated may be supplied under pressure to a reservoir chamber 5 formed in the body 1, as by way of a port 6 in the chamber 5 communicating with the inlet pipe 4. A recess 7 formed in the body 1 completes a slot with the cover panel 2 to receive the porous plug 3 without clearance. Suitable means for retaining the plug 3 against the pressure of a coating fluid is preferably provided. For this purpose, as shown, a rib 17 may be formed integral with the plug 3.

Figure 2:
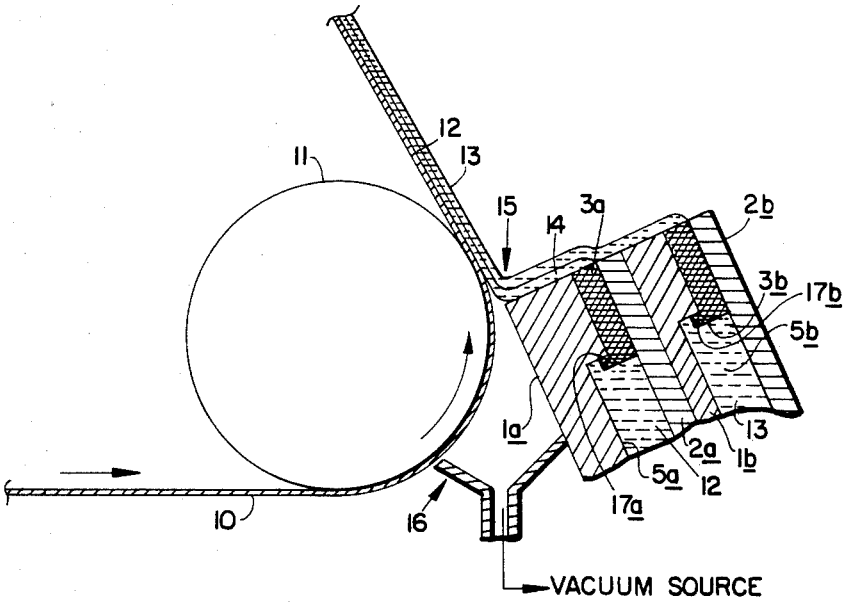
FIG. 2 is a schematic fragmentary elevational sketch, with parts shown in cross section, of the applicator of FIG. 1 as seen in part essentially along the lines 2—2 in FIG. 1 but on an enlarged scale, in association with a moving web undergoing coating.

Mating apertures, such as 8 in the cover panel 2, and 9 in the body, (FIG. 3) may be provided to receive bolts suggested at 10 in FIG. 1 to hold the parts together. As shown in FIG. 2, a plurality of units may be stacked to form a multilayer coater.

FIG. 2 shows two applicators of the kind shown in FIGS. 1 and 3 stacked to form a two layer cascade slide applicator. Corresponding parts are given reference characters that are the same in FIG. 1, but distinguished by the suffixes a for the lower applicator and b for the upper one as seen in FIG. 2.

As shown in FIG. 2, a moving web 10 passes over a driven roll 11 to be coated by two distinct superposed layers of coating composition 12 and 13. The layer 12 is supplied from the reservoir 5*a* through the porous plug 3*a*, from when it flows laminarly down an inclined slide surface 14 formed by the end of the applicator body 1*a*. Similarly, the liquid composition 13 is supplied under pressure to the reservoir 5*b*, flows through the porous plug 3*b*, and thence by gravity, in laminar flow, down a first slide surface formed by the ends of the body 1*b*, and the cover plate 2*a*, and over the layer of composition 12, forming two distinct layers without appreciable mixing.

Both the layers 12 and 13 are drawn down in a bead 15 formed in a gap between the end of the slide surface 14 and the web 10, and are entrained and drawn down on the web 10. A conventional vacuum box 16 may be provided, as schematically indicated, to stabilize the bead in a known manner.

Referring to FIG. 1, in which the fluid is not shown for clarity, the significant parameters determining coating weight and uniformity will next be discussed. Assuming the coating slot 7 has a width L, corresponding to the width of the web 10 to be coated, an x axis may be defined normal to the direction of flow, with x ranging from 0 at the lower edge of the slot 7 to L at the upper edge as seen in FIG. 1. The height h of the slot 7 will be a function of x determined by tolerances in manufacture.

The pressure outside of the slot will be Pa, generally atmospheric pressure. The pressure Pr in the reservoir 5 will be a function of x. In particular, there will usually be a pressure Pr1 in the center of the reservoir 5 at least somewhat different from the pressure Pr2 at the edges of the reservoir (x=0 and x=L).

The mass rate of flow dw of coating composition out of any incremental portion dx of the slot 7 will be $$dw=\rho Vhdx$$

where w is the mass flow rate, $\rho$ is the density of the liquid composition,

V is the downstream velocity, h is the height of the slot 7, and x is as defined above.

The velocity V is a function of the downstream pressure drop Pr−Pa. Since Pr is a function of x, V is also a function of x.

It would be desirable to make dw constant over the range x=0 to x=L. In practice, particularly with long slot widths L, this ideal condition cannot be attained. Conventionally, it is approached by making the slot height h small enough so that the average reservoir pressure, Pr ave., is high enough relative to the external pressure Pa so that, typically $$\left|\frac{Pr1 - Pr2}{Pr\ ave - Pa}\right| < .01$$

The resultant nominal slot height h in open slot coaters is so small that tolerances inherent in accurate machining and assembly, sag across the slot under the influence of gravitational forces, and small local variations in effective height h caused by particulate buildup, combine to make it very difficult to attain a uniform coating weight across the web. With the use of a porous plug in accordance with the invention, however, the downstream pressure drop Pr ave−Pa can be made large relative to the cross-stream drop Pr1−Pr2 in the reservoir 5, while keeping the nominal slot height h large relative to attainable manufacturing tolerances and to the size of particles that might build up during coating. Moreover, because of the large area of the flow channel through the interstices of the porous plug, any particulate buildup that does occur is most likely to take place in the plug, or on the upstream edge, rather than at the downstream edge where it would be apt to cause a discontinuity in the stream of coating composition.

Factors such as slide angle, coating gap, web speed and location of the applicator relative to the center line of the roll 11 may be chosen in the same manner as for a conventional multilayer cascade slide applicator. The slot height h can readily be made, for example, from 2 to 10 times larger than for an open channel coater for the same downstream pressure drop, by appropriate choice of the pore size in the plugs such as 3*a* and 3*b* in FIG. 2, and of the length of the plug in the downstream direction. In this regard, the dimensions and porosity of the porous plug should be chosen to increase both the downstream pressure drop and the slot height relative to those usual for open slot coaters, so that neither the cross stream pressure drop error nor the slot height variation error will predominate.

Porous plastic with pore sizes from 25 to 250 microns will be most useful for many applications, with the smaller pore sizes being preferred for low viscosity coating fluids, and the more open materials being better suited for use with higher viscosity coating fluids. Viscosities of liquids commonly coated may differ widely; viscosities from 1 cps to 300 cps and higher are commonly encountered. The pore size of the material chosen for the porous plugs should be large enough so that each plug will be relatively open compared with the upstream filters conventionally provided, so that the plugs will not normally act as filters, although they may be subject to gradual particulate buildup that may require flushing or replacement from time to time.

FIG. 2 shows the plugs 3*a* and 3*b* as of the same dimensions. In general, for a multilayer applicator in which several fluids of different viscosities are to be coated to different coating weights, a different plug for each slot may be desired, although some variations can be accommodated by reservoir pressure control.

Figure 4:
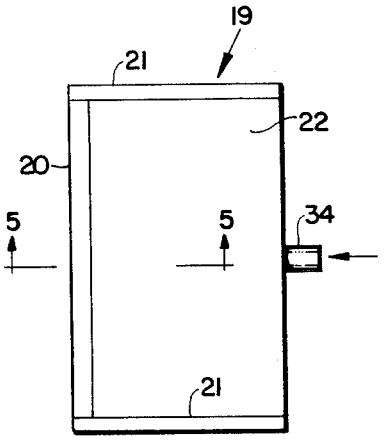
FIG. 4 is a plan view of a multilayer bead coater in accordance with another embodiment of the invention.
Figure 5:
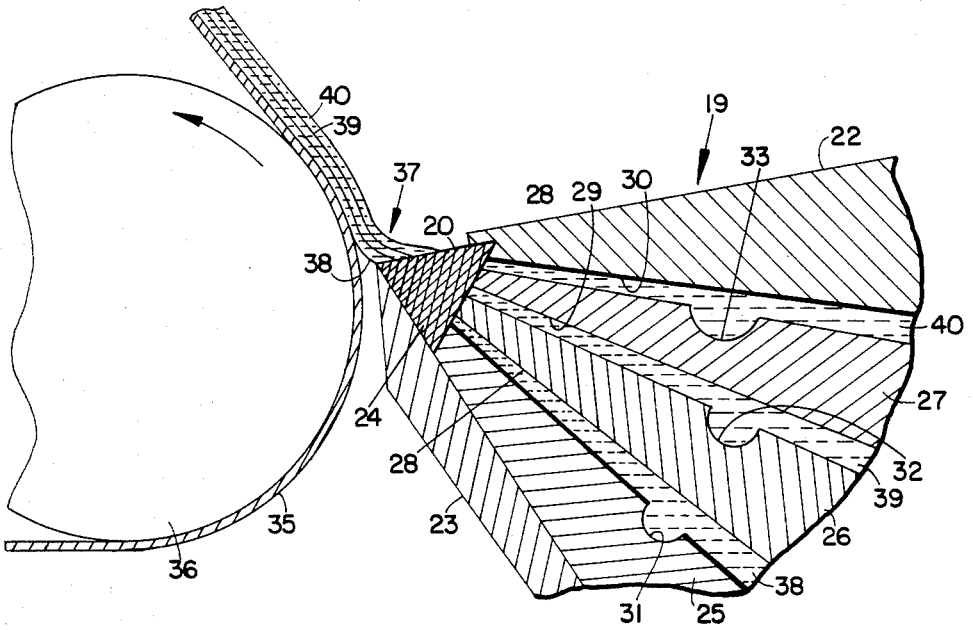
FIG. 5 is a schematic fragmentary elevational sketch, with parts shown in cross section, of the applicator of FIG. 4 as seen in part essentially along the lines 5—5 in FIG. 4 but on an enlarged scale, in association with a moving web undergoing coating.

FIGS. 4 and 5 illustrate a modification of the invention in which a single porous plug provides a multilayer metering channel for a plurality of coating streams in a multilayer extrusion coater. The overall aspects of the applicator are shown in plane view at 19 in FIG. 4. An elongated porous plug 20, shown to be of triangular cross section in FIG. 5, extends across the lip of the applicator 19 between end plates 21. A top plate 22 is secured to and between the end plates 21 in any conventional manner.

Comparing FIGS. 4 and 5, the elongated triangular porous plug 20 is captured between the end plates 21, a bottom plate 23, and a notch 24 formed in the edge of the top plate 22. The base of the plug 21 is supported by the ends of three intermediate applicator plates 25, 26 and 27.

The bottom plate 23, and the intermediate applicator plates 25, 26 and 27, are fastened to and between the end plates 21 in any conventional manner, not shown. The plates 22, 23, 25, 26 and 27 may be of any suitable metal, such as stainless steel or the like, or preferably of a lighter material for the construction shown, such as a conventional thermoplastic or thermosetting resin, for example, an epoxy, polyester or acrylic resin or the like. These lighter and less rigid materials can be employed because of the relaxed requirement for dimensional tolerances characteristic of constructions in accordance with the invention and discussed above.

The applicator plates 22, 25, 26 and 27 are generally trapezoidal in cross section, and are spaced to provide convergent flow channels 28, 29 and 30. As shown, cross-stream pressure equalizing reservoirs 31, 32 and 33 are preferably formed in the channels 28, 29 and 30, respectively.

Fluid compositions to be coated are supplied to the applicator 19 under pressure by conventional means, as through inlet pipes such as 34 in FIG. 4. The lip of the applicator is positioned adjacent and spaced from a moving web 35 to be coated as the web is moved past the applicator over a driven roll 36. A multilayer bead 37 of the coating compositions is formed in the gap between the lip of the applicator and is entrained and drawn down onto the surface of the web 35.

In particular, as shown, a first liquid coating composition 38 is supplied to the channel 28 and flows through a lower zone of the porous plug 20 to form the lowermost layer in the bead 37. A second liquid coating composition 39 is supplied through the channel 29, and flows through an intermediate zone in the plug 20 to form the middle layer in the bead 37. A third liquid coating composition 40 is supplied through the channel 30, and flows through an upper zone in the plug 20 to form the upper layer in the bead 37. The three liquid layers will remain essentially distinct because they are in laminar flow through the plug, and elsewhere in the coating apparatus, and there is no effective cross-stream mixing mechanism in the plug. If desired, more or less than three coated layers can be provided for by the addition or removal of intermediate applicator plates such as 26.

Figure 6:
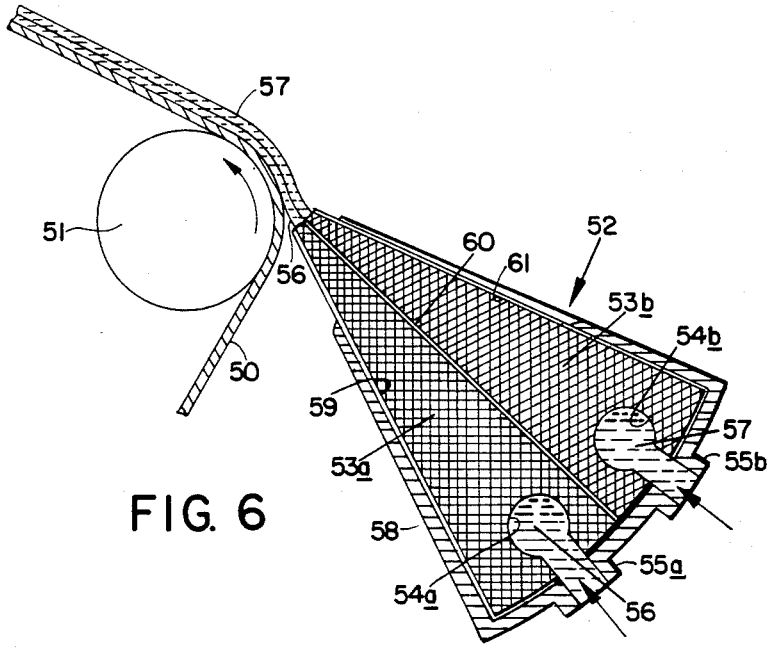
FIG. 6 is a view similar to FIG. 5 but showing another modification of the invention.

FIG. 6 illustrates a modification of the invention in which full advantage is taken of the weight saving potential of the invention. As shown, a web 50 to be coated is moved over a driven roll 51 past a coating station and spaced by a desired gap from the lip of a multilayer extrusion coater generally designated 52. The applicator 52 shown is arranged to apply a two-layer bead of coating compositions to the web 50; it will be apparent to those skilled in the art that one, or more than two, layers, could be provided for by simply removing or adding coating units of the kind to be described.

Each coating unit in the applicator 52 comprises a porous plug such as 53*a*, 53*b* that is elongated across the web in directions normal to the plane of the drawing, and is of wedge-shaped cross section as shown. The plugs such as 53*a* and 53*b* are formed with reservoirs 54*a*, 54*b* communicating with inlet ports 55*a*, 55*b* formed in an external housing 58, of sheet metal, plastic or the like, for the coating units.

The porous plugs such as 53*a* and 53*b* are enclosed, except at their inlet apertures and exit ends, in liquid impermeable skins such as 59, 60 and 61. The skins may be of any suitable material, such as plastic or the like, for example, of a vinyl film a few mils in thickness. The skins may be adhered to the plugs with an adhesive, or formed by heat applied to the plugs to fuse and seal their surfaces.

A fluid coating composition 56 supplied to the reservoir 54*a* under pressure will flow through the porous plug 53*a* and exit at the lip of the applicator to form the lowermost layer of a bead that is entrained and drawn down on the web 50. Similarly, a fluid composition supplied under pressure to the reservoir 54*b* will flow through the plug 53*b* and form a layer contiguous with and distinct from the layer of composition 56.

Coating weight of the various layers laid down by the applicator 52 is determined primarily by the pressure in the reservoirs, the dynamic flow characteristics of the fluids being coated, and the dimensions and porosities of the plugs, as well as by the width of the plugs at their exit ends corresponding to the slot height h in the slide coater of FIG. 1. Thus, either or both increasing the length of the plugs in the downstream direction and reducing the porosity of the plugs can be used either or both to increase the widths of the plugs at their exit ends and to increase the downstream pressure drop at a given coating weight.

An advantage of the construction of FIG. 6 is that the multiple coated layers come into contact for a very short time before coming onto the web. Thus, relatively incompatible fluids, such as aqueous compositions and alcohol solutions or dispersions, can be coated as distinct layers without undue interaction before chilling and setting and then drying as distinct layers on the web.

While the invention has been described with reference to the details of various particular embodiments, many changes and variations will occur to those skilled in the art upon reading this description, and such can be made without departing from the scope of the invention.

Having thus described the invention, what is claimed is:

1. A multilayer coater, comprising a plurality of elongated applicator plates, means mounting said plates in spaced relation to form a plurality of converging flow channels elongated in a direction normal to the direction in which said channels are converging, and an elongated porous element mounted at the convergent ends of said channels and blocking said convergent ends, whereby fluid compositions supplied to said channels under pressure will flow through said element while experiencing pressure drops that are large compared to the cross stream pressure drops in said channels.

2. The coater of claim 1, in which the sizes of the pores in said porous element are between 25 and 250 microns.

3. A multilayer coater, comprising a plurality of contiguous elongated wedge shaped porous elements separated by liquid-impermeable membranes and forming converging porous channels for conveying liquid coating compositions to a common multilayer bead for entrainment on a web moving adjacent said bead, said channel being spaced from the web by a gap.

4. The coater of claim 3, in which the sizes of the pores in said porous elements are between 25 and 250 microns.

* * * * *